US006500042B1

(12) United States Patent
LaPointe

(10) Patent No.: US 6,500,042 B1
(45) Date of Patent: Dec. 31, 2002

(54) FOAM TRAJECTORY TOYS

(75) Inventor: Brian K. LaPointe, West Yarmouth, MA (US)

(73) Assignee: Cal-Side (USA) Ltd., Portland, OR (US)

( * ) Notice: Subject to any disclaimer, the term of this patent is extended or adjusted under 35 U.S.C. 154(b) by 0 days.

(21) Appl. No.: 09/611,797

(22) Filed: Jul. 7, 2000

Related U.S. Application Data

(60) Provisional application No. 60/143,184, filed on Jul. 9, 1999.

(51) Int. Cl.[7] ..... A63H 27/00; A63H 33/18

(52) U.S. Cl. ..... 446/64; 124/20.3

(58) Field of Search ..... 124/17, 20.1, 20.3; 446/34, 64; 473/578

(56) References Cited

U.S. PATENT DOCUMENTS 3,014,308 A * 12/1961 Parris
4,802,677 A * 2/1989 Homan
5,282,453 A * 2/1994 Chia ..... 124/20.1
6,247,990 B1 * 6/2001 Moorhouse ..... 446/64

* cited by examiner

*Primary Examiner*—John A. Ricci
(74) *Attorney, Agent, or Firm*—Kolisch Hartwell, P.C.

(57) ABSTRACT

The projectile toy includes an elongate projectile member having a body portion connected to a nose portion. The body portion has a rigidifying structure, and the nose portion is made of a unrigidified foam. A hook device is connected to the body portion near the nose portion. An elastomeric tether for engaging the hook device can be stretched and released causing the projectile member to launch with the nose portion in front.

4 Claims, 13 Drawing Sheets

FOAM TRAJECTORY TOYS

CROSS-REFERENCE

This application claims priority from U.S. Provisional Patent Application Serial No. 60/143,184, filed Jul. 9, 1999.

FIELD OF THE INVENTION

The invention relates to toys, particularly foam toys that are designed to be projected through the air safely with entertaining trajectory characteristics.

BACKGROUND OF THE INVENTION

Projectile toys of many types have been popular for many years. However, it is often difficult to provide projectile toys that are safe without compromising aerodynamic objectives. Accordingly, there is a need for toys that are made of lightweight compressible materials that exhibit interesting and entertaining movement or flight qualities.

SUMMARY OF THE INVENTION

The invention is a projectile toy which comprises an elongate projectile member having a body portion connected to a nose portion wherein the body portion has a rigidifying structure and the nose portion is made of unrigidified foam. A hook device is connected to the body portion near the nose portion. An elastomeric tether engages the hook device so that the tether can be stretched and released causing the projectile member to launch with the nose portion in front.

DESCRIPTION OF THE INVENTION

Figure 1:
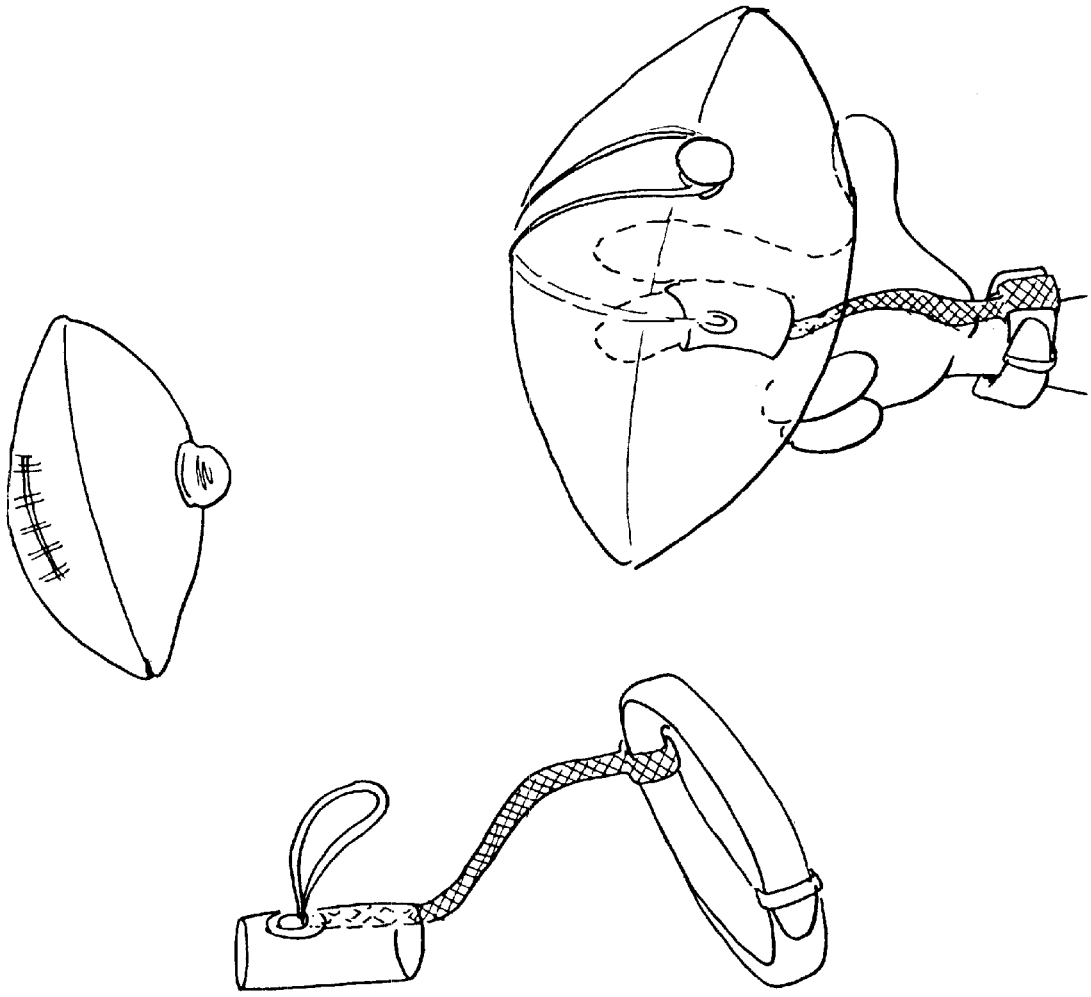
FIG. 1 is a football.

Slingshot Football—Spiralator (FIG. 1)

Concept is a means for allowing non skilled users to consistently throw the illusive perfect "perfect spiral" football pass.

Device consists of two parts. The first part is a "power glove" which is at least a wrist strap with a tethered elastic. The "power glove" possibly also contains a band of nylon webbing which attaches to a tube through which a finger is inserted. The elastic may be attached at the point closest to the finger tip when the "power glove" is in place.

The second part of the device is a football with a securing point for the tethered elastic.

The "power glove" is worn on the user's throwing hand. The football is placed in the palm. The elastic is then hooked over the securing point on the football. The ball is then rotated on an axis away from the fingertips. Tension is created on the elastic. As the user throws the ball and releases, the elastic which causes the ball to rotate or spin what is commonly referred to as the perfect spiral.

The concept is to create a ball that leaves the thrower's hand in a spiral-spinning manner. This can be a toy or a training aid. As a football, this teaches the user the proper technique for throwing a "spiral" football. As a baseball, this device could be used for special pitches.

The significant interaction between the two components, the "glove" component and the "ball" component occurs at the time when the ball departs the user's hand. The result of the interaction between these parts is as the ball leaves the hand of the person throwing the ball, it is strongly twisted and the result is that the ball spins rapidly creating a "spiral" throw.

The device consists of two components:

The first component is a ball which has a small portion of the surface area designed to enable the ball to interact with the second component (the ball) in such a manner that as the ball departs the thrower's hand, it is torqued or spun, resulting in a spinning ball.

The ball component surface may be simply an area with a hole to receive another object, or may be a raised area to create a hook around which a cord connects, or may contain one portion of a fastener, such as hook-and-loop or hook-and-hook fasteners.

The second element is a piece that the user affixes to the hand, wrist or forearm. This may be in the form of a glove or a band or a single ring, which contacts the ball component directly or indirectly.

Various Methods of Constructing the Components

The first component:

a. The ball surface may have a raised or lowered area to create a small notch or hook device on the ball around which a static or elastic cord may connect. As the ball is being thrown, the cord contacts this surface sufficiently to spin the ball, and as the ball departs the thrower's hand, the cord drops off and releases b. The ball component may have a one side of a two-sided fastener which spins the ball and then detaches as the ball departs the thrower's hand.

c. The ball may contain a hole into which a device such as a small ball or rod is inserted which catches and spins the ball but releases as the ball departs the thrower's hand.

The second component:

The second component is a glove device affixed to the finger, wrist or forearm and is not thrown with the ball. The glove provides a secure point of attachment to the user for the portion of the device that interacts with the ball.

The glove device may be in the shape of a full-fingered glove, it may be a series of strips of webbing or it may be as simple as a single band which wraps around a single finger.

The portion of the second component that interacts with the ball:

A static or elastic cord or band can be attached near the near the end of a finger, palm or back of hand. This cord is then extended to connect directly or indirectly with the ball.

A direct connection could be one where the cord wraps around a hook or protrusion, or inset on the ball so that when the ball is thrown, this cord catches this point and creates a spin on the ball as the ball leaves the user's hand.

Another way in which the cord may connect with the ball:

The device that contacts with the ball may be the second portion of a fastener, such as the loop in a hook-and-loop fastener, the ball or rod which is inserted or placed in a corresponding location on the ball, or a length of cord.

Fastener at the end of the finger without a cord.

The fastener is affixed to the tip of the finger.

Figure 2A:
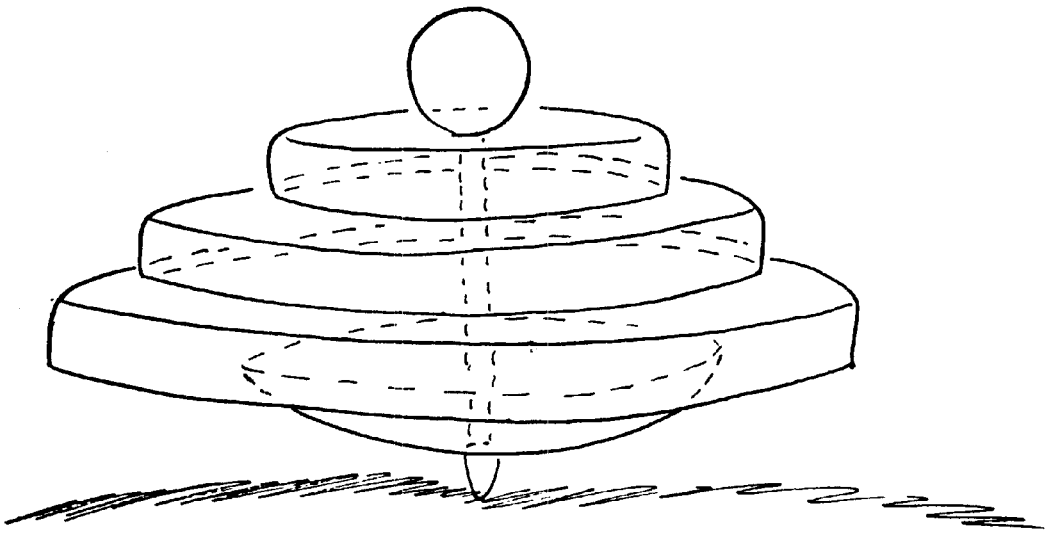
FIGS. 2A–2C are views of a spinning top.
Figure 2B:
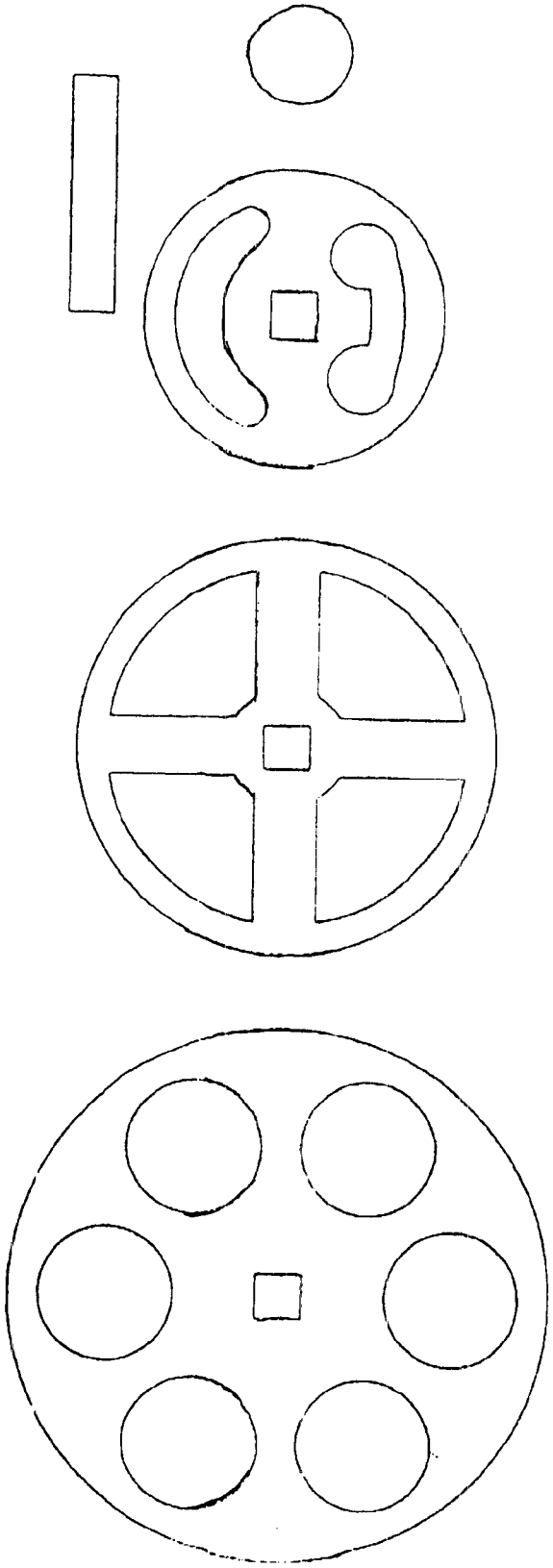
Figure 2C:
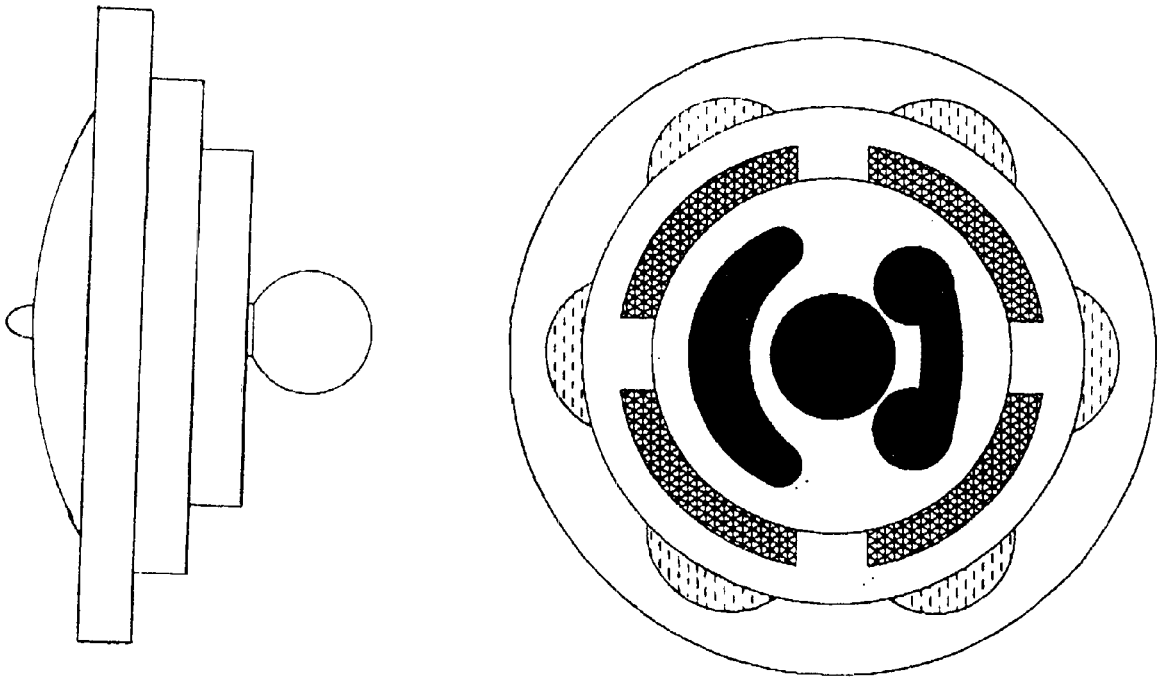

Spinning Wet/Dry Top (FIGS. 2A–2C)

The concept is a top which will spin on any hard flat surface and also spin while floating in the water. Device disassembles and becomes an easy to reassemble item.

Device is a foam top which can be used either as a top or a building toy.

Device consists of a formed base, rings with or without removable pieces and a central shaft with a knob on one end. The top is weighted and balanced for a maximum rotation effect.

Figure 3:
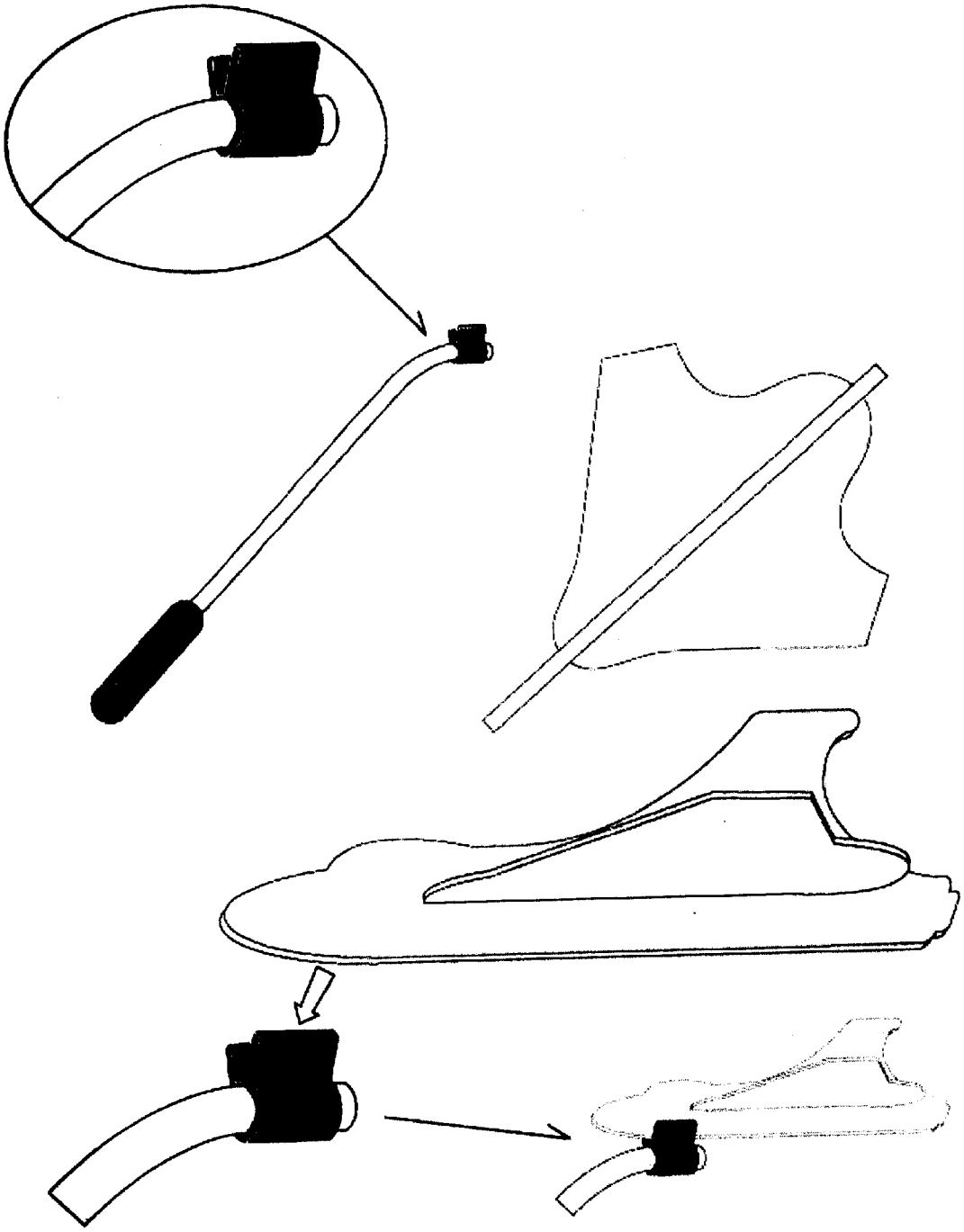
FIG. 3 is a foam glider with a launcher.

Glider with Power Launcher or Throwing Stick (FIG. 3)

Concept: The mechanical advantage provided by use of the throwing stick increases the distance which the plane can be thrown. Making the contact point between the airplane and throwing stick adjustable along a radius at the end of the stick makes this concept available to even the youngest users.

Device: Consists of two items:

a. foam glider b. throwing stick with adjustable contact point

Figure 4:
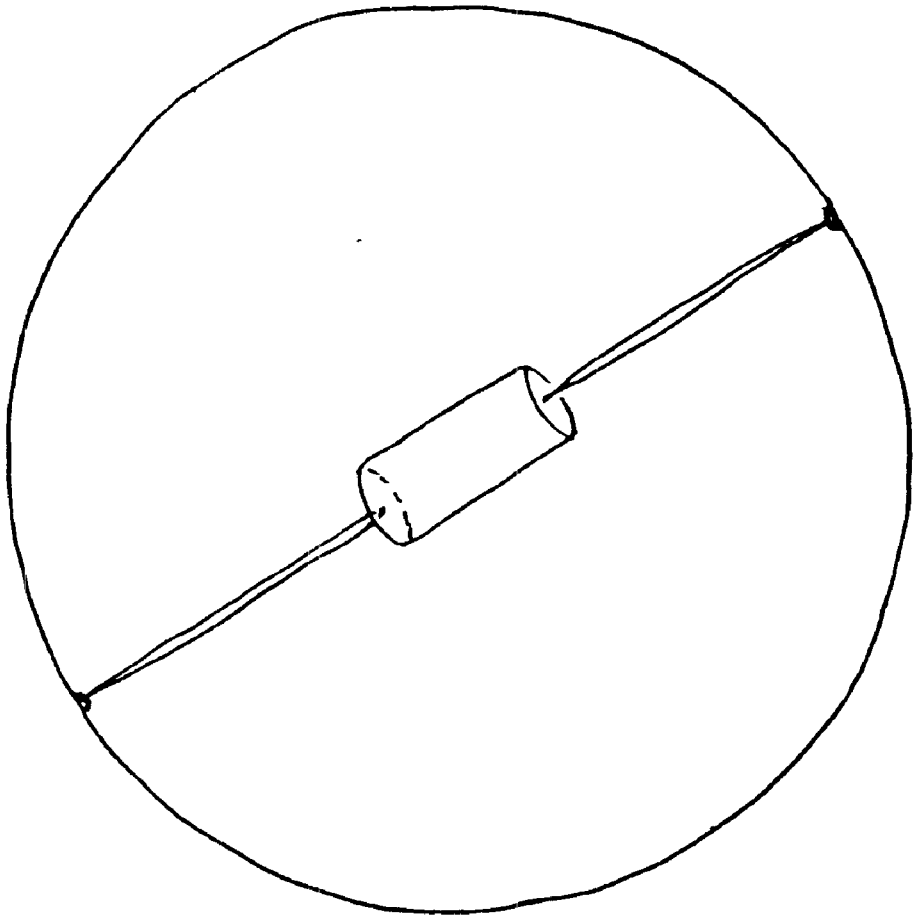
FIG. 4 is a ball with a weight suspended in the center of the ball.

Unpredicataball—Spaz Ball—Palsely Ballsey (FIG. 4)

Concept: Hollow sphere with weight suspended on elastic between two poles. When thrown, rolled, hit or kicked, the suspended weight bounces on the elastic tethers. As the ball rolls in one direction, the weight is activated and bounces in all directions. The elastic stores and returns this energy, creating pulling force on each pole-creating a slight shift in trajectory of the ball.

Device: Consists of a hollow sphere with a weight suspended on elastic tethers at the center of the ball.

The device is a hollow ball that shakes when thrown, kicked, rolled or hit. This ball concept can be made in sizes ranging from 1" to many feet in diameter.

At opposite interior poles of the ball are attachment points for a length of elastomeric material. Suspended by this elastomeric material is a weight. This weight may be set in the center or off-center, depending upon the type of movement desired.

When the ball is thrown, the weight tensions the elastomeric material and snaps back and forth until the weight is once again in the neutral position, suspended between these two poles. The tensioning back and forth of the elastomeric material transfers some of this energy to the exterior of the ball, causing sudden, slight back and forth movements of the ball. The result is a ball that shakes and rolls in an unpredictable manner.

Figure 5:
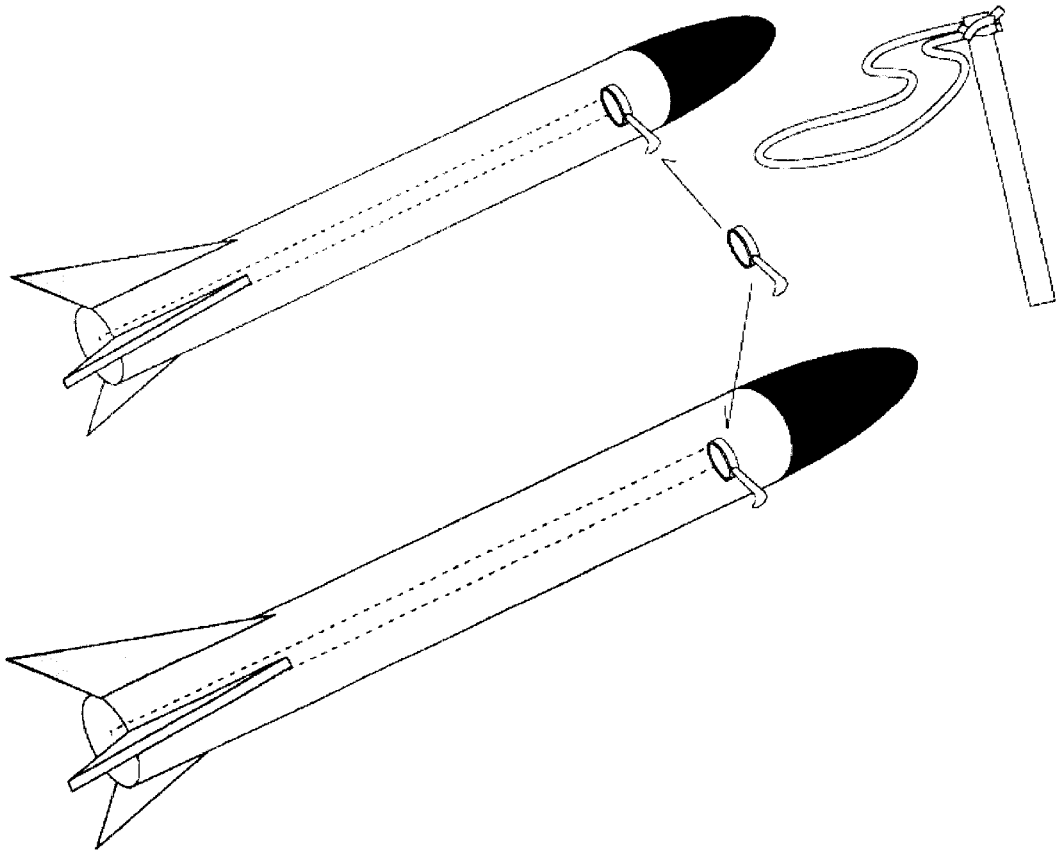
FIG. 5 is foam rocket with a launcher.

Slingshot Rocket (FIG. 5)

Concept: A foam rocket with a launcher. Rubber band launched rocket which is launched from a hook protruding from the fuselage portion of the rocket. The impact point of the rocket consists of two or more types of foam which absorb impact force.

Device: Consists of two pieces.

a. Foam rocket with hook on fuselage. Fuslage and nose sections are comprised of multiple layers of foam.

Fuselage is reinforced with a stiffer rod which runs from bottom of base to about 75% of the length of the rocket. At the end of this rod is the contact point for the launch hook mechanism. This design provides for stiffness of the foam rocket so it does not bend under the stress of being pulled back from the launcher. Other models would wrap and not shoot straight or could even tear. That the rod stops about 25% of the total length of the rocket short of the tip, the impact is absorbed solely by foam and the impact area does not experience impact from hard components.

b. Launcher comprised of handle, elastic cord, and possibly a sight for aiming. Launcher consists of a handle possibly with a sighting apparatus, and an elastic band. Fuselage and nose sections are comprised of multiple layers of foam.

Historically, catapult-launched hobby or toy rockets have traded. A safe foam to rocket would shoot, but when strongly pulled back on a catapult launcher, the rocket would flex, resulting in an erratic and unpredictable flight path.

This design overcomes the flexibility of the rockets while retaining a principal safety feature—minimized weight.

Methods for stiffening the fuselage:

The foam fuselage can be stiffened a number of ways, the preferred method being a length of foam tuning having a lightweight rod or tube running from near or at the base of the rocket to more than half the length of the rocket.

The reinforcing rod stops before the end of the fuselage for safety purposes. The rocket has a foam nose cone which absorbs most of the impact while the non-reinforced or stiffened portion of the fuselage functions in various ways:

1. It acts as a shock absorber, absorbing the impact of the rocket, and adding a secondary cushioning after the foam nose cone.
2. It prevents the reinforcing rod from being exposed at the end of the rocket, in the event that the foam nose cone is removed. This increases the safety of the product.
3. It allows additional surface area contact for the adhesives used when affixing the nose cone to the rocket.
4. Upon impact, this area flexes and diverts the force of impact, again increasing the safety of the product.

Methods for attaching the hook:

The hook does not connect with the inside reinforcing rod. This eliminates the possibility of launching only the reinforcing rod in the event that the nose cone came off of the rockets.

The hook may be inserted into the exterior of the foam tubing, pass through the foam tubing to and attached to the rod or taped on the exterior of fuselage tube A second method of constructing this rocket would be using a light weight, thin walled rigid or semi rigid tube onto the outside of which is secured a hook device designed to work with the elastic catapult mechanism.

Figure 6:
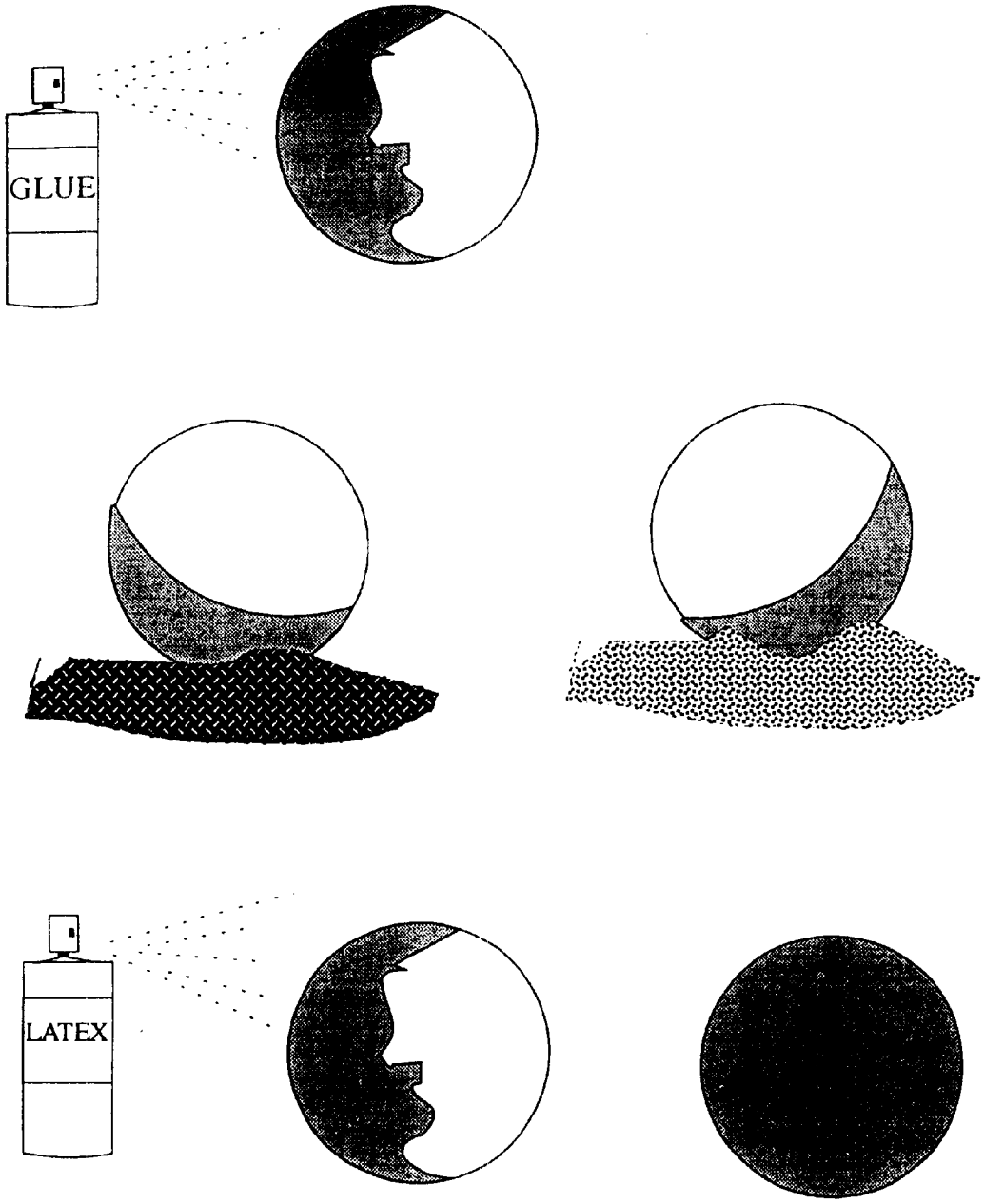
FIG. 6 are views of a process of covering a surface of a ball with foam shavings.

Regrind Ball (FIG. 6)

Concept: A process ball consisting of a hollow or solid base covered in adhesive, covered with shredded pieces of foam, and sealed with a covering creating a membrane around the recycled foam.

Existing problem: Traditional solutions to the problem of recycling foam has been the change in the fundamental properties of foam upon compression and exposure to heat. The foam experiences an increase and hardens, and a decrease in impact cushioning and also a decrease in perceived value.

The process:

Scrap foam is ground into small pieces.

Surface is prepped with the application of an adhesive. Surface is covered with recycled foam shavings. Remaining area may or may not be filled with smaller pieces of foam.

By way of a spray or dip application, a second flexible layer is applied over the foam pieces. The result is a flexible covering of a foam covered item with a sold skin. This covering over a ball provides a ball of unique design with no two balls being alike.

Figure 7:
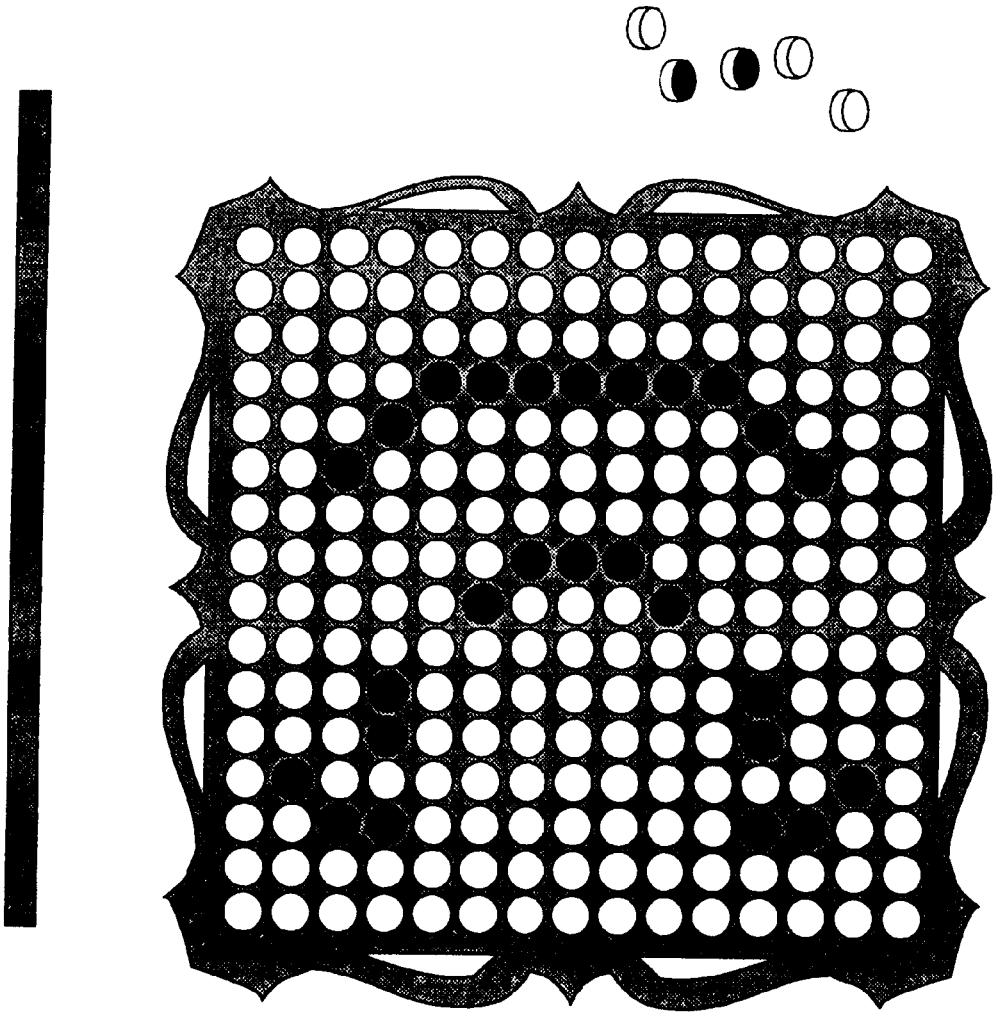
FIG. 7 is a solid sheet of foam in which a user may create patterns or pictures.

Punch Art (FIG. 7)

Concept: A simple device with which user can create images by punching out and turning over pieces of foam from a solid sheet.

Device: A device by which the user can create patterns or pictures by turning, pulling out, flipping over and replacing foam dots which have different colors on each opposite surface. When replaced in the hole, the visible surface of the foam dot either blends in with or contrasts with the background. The contrasting dots can be arranged in such manner as to create shapes, pictures or letters.

Figure 8:
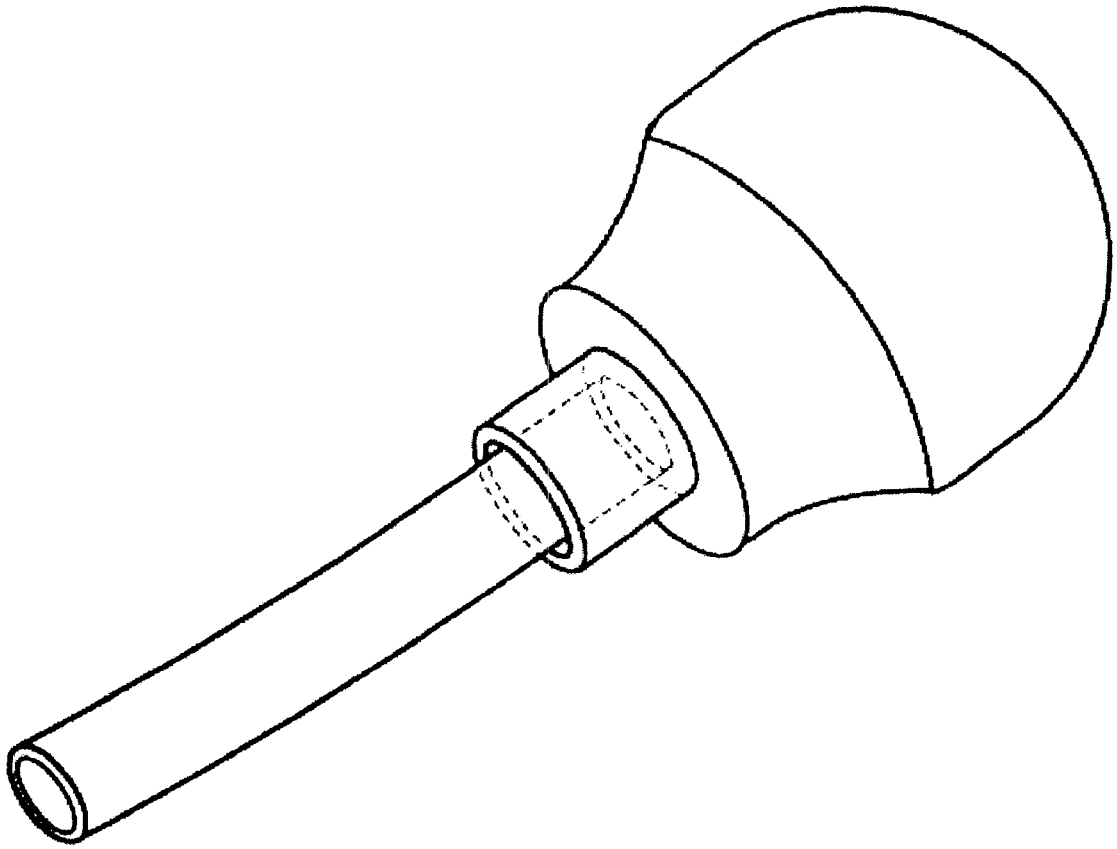
FIG. 8 is a view of a propulsion mechanism for projecting a ball, foam plane, foam rocket or other designs.

Elastic Compression Launch Mechanism (FIG. 8)

Concept: A safe, efficient mechanism providing propulsion applicable to a number if small, lightweight foam flying items.

Overcomes existing problems: Current self propelled design utilize propulsion mechanism which are exposed at or near the tip of the projectile. Although a number is these retract into the device, a portion of the propulsion mechanism is often exposed or the opening into which the propulsion mechanism retreats into is often harder than the surrounding area.

Device is comprised of an elastomeric length which may by affixed to the projectile by adhesive, a fixture device outer manner (tied in a knot secured within the projectile). The elstomeric material is pulled and released creating a transfer of energy from the constricting elastomeric material into the projectile. This pull back, release, snap creates sufficient force to power a ball, foam plane, foam rocket or a hundred other designs.

This device can be located on the back or on:

Fire Balls—Powerballs

Fire Plane

Fire Rocket

Super ball character families.

This concept is a safe, efficient mechanism designed to provide propulsion to a number of small, lightweight projectiles such as balls, planes, rockets, and many other forms.

This concept addresses the problem created by self-propelled projectiles where the mechanism is located on the leading edge of the projectile in flight. Usually, these mechanisms have hard components and issues of safety arise.

The device propulsion mechanism is an elastomeric length affixed directly in the projectile.

The user aims the projectile in the desired direction of travel. The elastomeric length is at the back of the projectile. The user then pulls back and extends the elastomeric length. The user then releases the elastomeric length which compresses and the energy from the compression is transferred into the projectile and acts as the launching mechanism.

Methods for affixing the elastomeric length in the projectile:

The projectile may have a hole in the surface through which the length is passed. The end of the length that passes though the hole may be secured by a number of methods.

The length may be glued inside the hole.

The length may be knotted in the hole.

The length may be glued.

The portion of then length which is passed through or into a hole on the back of the projectile. The portion of the elastomeric length which has been passed through the hole may then be expanded, a piece of material larger than the inner diameter of the hole through which the elastomeric length has been passed through is then inserted, the length is then contracted around the material. This creates a bulge in the length larger than the tube and stops the tube from passing through.

This mechanism may be incorporated into a number of items, including but not limited to foam balls, small planes, small rockets, small animated characters.

Foam balls, small planes, small rockets, small animated characters.

Figure 9:
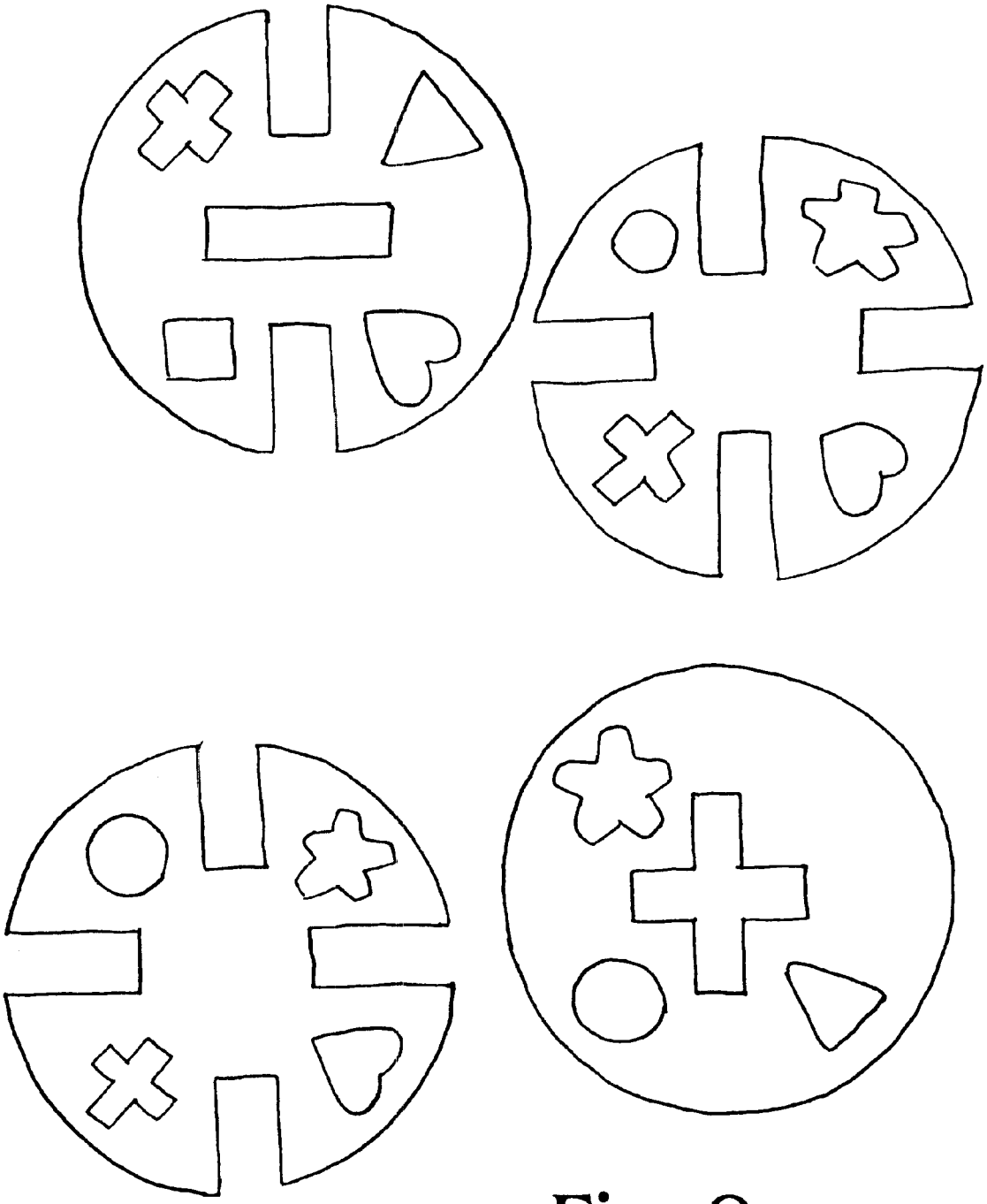
FIG. 9 are views of a ball constructed with interlocking foam pieces.

Wonderball (FIG. 9)

Concept: A ball constructed of three interlocking pieces of foam which intersect each other at the X, Y and Z axis.

Device: A ball constructed of three interlocking pieces of foam which intersect each other at the X, Y and Z axis.

Each of the twelve triangular portions create a space into which a removable and replaceable shape may be die cut out resulting in a shape sorter play pattern.

Figure 10:
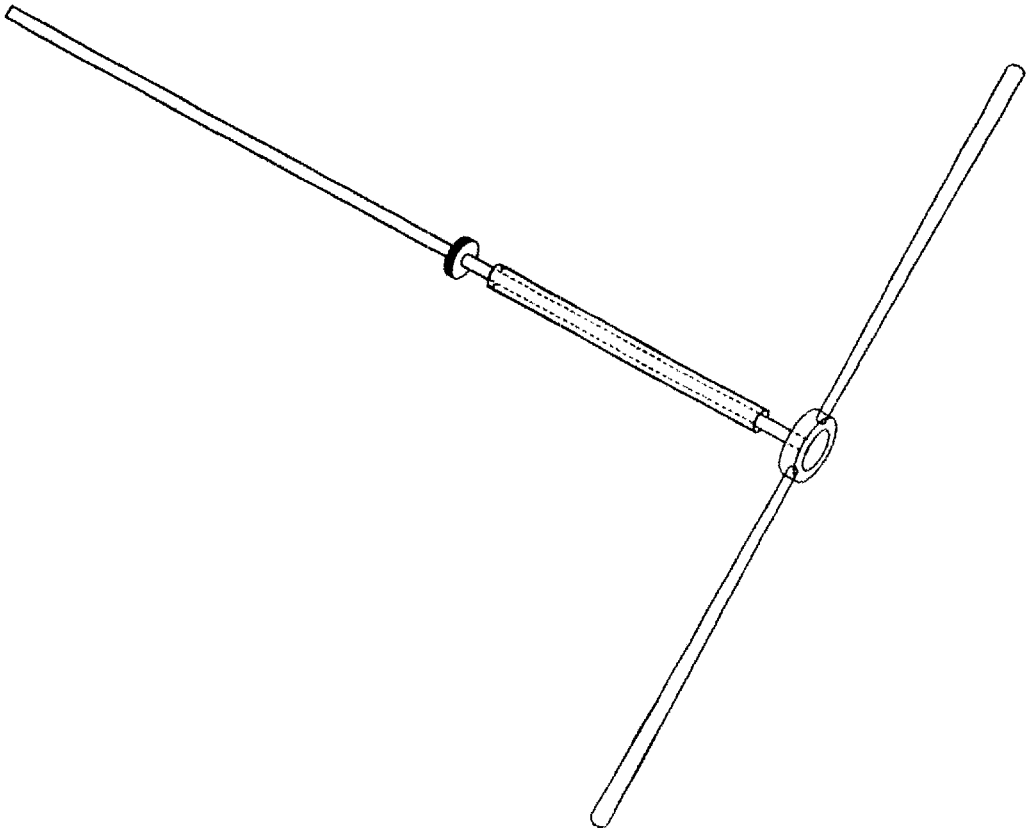
FIGS. 10 and 11 are views of a foam helicopter with a propeller on a stick.
Figure 11:
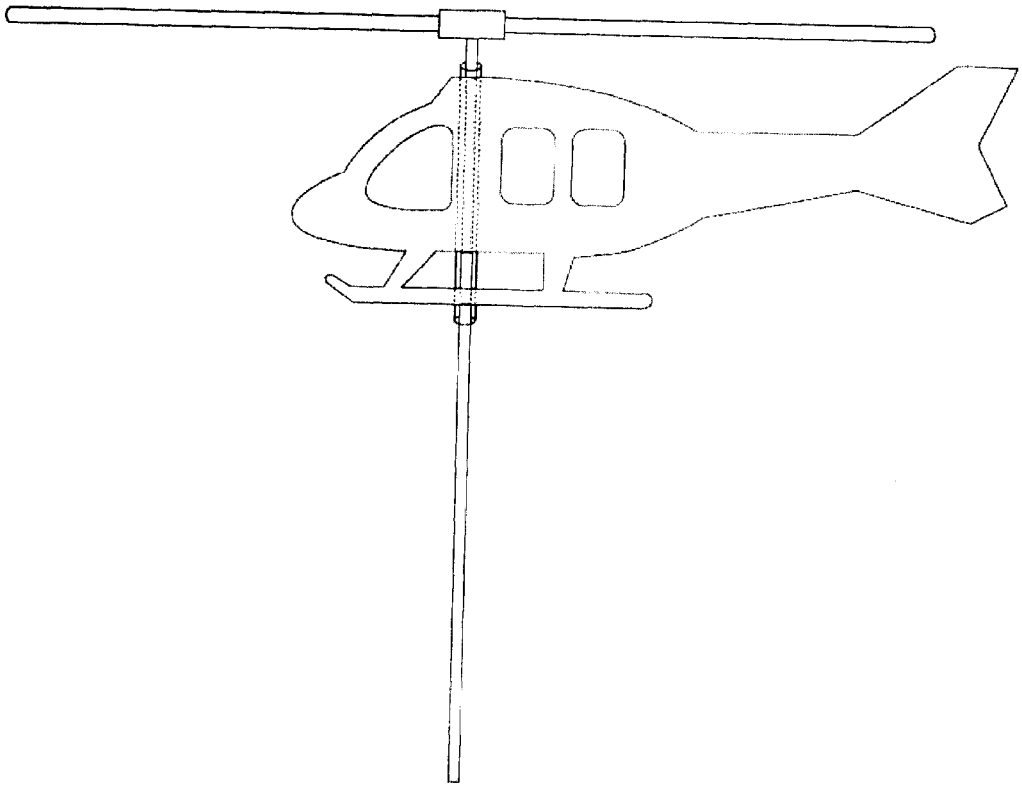

Gyrocopter (FIGS. 10 and 11)

Concept: Adding a die cut shape to the traditional propeller on a stick flying toy. The device will rise and appear to fly away.

Device consists of a propeller on a stick, a die cut piece of foam the profile of a helicopter (or any other shape Beer Can—Flying Clown holding balloons etc.), with or without a sleeve covering the contact point between the foam acting as a bearing to allow the shaft to spin freely within a hole passing through the foam.

Application: Premium/Promotional business as a high profile give away item or as a store bought toy device.

Variation: Provides for noise—(the playing card into the spokes method of noise generation) By way of a raised bump on the central circular portion of the propeller the propeller spins and produces a whaomp whaomp whaomp sound each time the propeller completes one revolution.

The opposing flat surfaces of the image provide an excellent billboard area for imprinting a company's advertising information.

A hand launched propeller on a shaft has been around as a toy for a long time.

Various mechanized helicopter toys have also existed.

What is new is bringing dimension to this concept in the form of a fixed two- or three dimensional shape under the rotor. The adding of this visual element changes the product from being a simple propeller to being viewed as an actual helicopter.

A cut out profile of a helicopter shape is the preferred embodiment of this improvement. Numerous other forms are possible, such as a jet, bird, manned balloon etc. The high visibility of this item also creates a strong advertising specialty item.

A two dimensional material is cut out, helicopter details are added by way of pad printing, screen printing, embossing or other methods.

This helicopter form has a hole cut through for the propeller shaft. Inside this shaft may or may not also be a sleeve that acts as a bearing to reduce friction between the shaft and the helicopter profile.

This helicopter profile is secured on the shaft at bottom and possibly also the top. This prevents the shaft from separating from the helicopter profile. Additionally, this fixes the placement of the helicopter profile along the shaft to provide preset but variable positioning for the sound element of the item.

The second innovation on this toy is the addition of a mechanism that creates sound by placing a small piece of semi rigid material in the path of the rotor.

This can also be achieved by creating a protrusion at the center of the propeller, where the rotor blades meet, so that the protrusion is contacted by the propeller as it revolves.

I claim:

1. A projectile toy comprising an elongate projectile member having a body portion connected to a nose portion wherein the body portion has a rigidifying structure and the nose portion is made of unrigidified foam, a hook device connected to the body portion near the nose portion, and an elastomeric tether for engaging the hook device so the tether can be stretched and released causing the projectile member to launch with the nose portion in front.

2. The toy of claim 1 wherein the rigidifying structure is a rod running through the body portion.

3. The toy of claim 1 wherein the body portion spans approximately 75% of the length of the projectile member.

4. The toy of claim 1 wherein the hook device is connected to the rigidifying structure.

* * * * *